US011074864B1

(12) United States Patent
Lu et al.

(10) Patent No.: US 11,074,864 B1
(45) Date of Patent: Jul. 27, 2021

(54) TFT PIXEL THRESHOLD VOLTAGE COMPENSATION CIRCUIT WITH GLOBAL COMPENSATION

(71) Applicant: Sharp Kabushiki Kaisha, Osaka (JP)

(72) Inventors: Tong Lu, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/830,888

(22) Filed: Mar. 26, 2020

(51) Int. Cl.

| | |
|---|---|
| ***G09G 3/325*** | (2016.01) |
| ***G09G 3/3258*** | (2016.01) |
| ***G09G 3/36*** | (2006.01) |
| ***G09G 3/3291*** | (2016.01) |

(52) U.S. Cl.
CPC ..... *G09G 3/325* (2013.01); *G09G 3/3258* (2013.01); *G09G 3/3291* (2013.01); *G09G 3/3659* (2013.01); *G09G 2300/0852* (2013.01)

(58) Field of Classification Search
None
See application file for complete search history.

(56) References Cited

U.S. PATENT DOCUMENTS

| | | | | |
|---|---|---|---|---|
| 7,414,599 | B2 | 8/2008 | Chung et al. | |
| 8,830,219 | B2 | 9/2014 | Choi et al. | |
| 9,269,297 | B2 | 2/2016 | Kanda et al. | |
| 10,223,964 | B2 | 3/2019 | Han | |
| 2014/0111563 | A1* | 4/2014 | Hwang | G09G 3/3233 345/691 |
| 2014/0152191 | A1* | 6/2014 | Yang | G09G 3/3233 315/240 |
| 2017/0294162 | A1* | 10/2017 | Hu | G09G 3/3266 |
| 2018/0211600 | A1* | 7/2018 | Nie | G09G 3/3233 |

* cited by examiner

*Primary Examiner* — Chad M Dicke
(74) *Attorney, Agent, or Firm* — Renner, Otto, Boisselle & Sklar, LLP

(57) ABSTRACT

A pixel circuit compensates the threshold voltage variations of the drive transistor with an ultra-short one horizontal (1H) time, with additionally removing the possible memory effects associated with the light-emitting device and the drive transistor from the previous frame. An ultra-short 1H time (<2 μs) is achieved via separation of threshold compensation of the drive transistor and data programming phases. The pixel circuit has a two-capacitor configuration, whereby a first capacitor is used for drive transistor threshold compensation, and a second capacitor is used to store the data voltage during a data pre-loading phase. Two transistors are employed to electrically connect the gate of the drive transistor to the second capacitor that stores the data voltage, wherein each transistor in this dual transistor configuration is controlled by a different control signal. A timing sequence of the different control signals is used to ensure that a mid node of the dual transistor configuration is refreshed before the data is applied to the gate of the drive transistor. An array of individual pixel circuits is controlled using a global compensation scheme in which global control signals are applied to the individual pixel circuits of the pixel array.

14 Claims, 4 Drawing Sheets

TFT PIXEL THRESHOLD VOLTAGE COMPENSATION CIRCUIT WITH GLOBAL COMPENSATION

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a large amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is dictated by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such a circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for data programming. When the data is programmed during the same operational phase as the drive transistor is compensated, the one horizontal time cannot be reduced further due to compensation accuracy requirements for the drive transistor, as the compensation requirements limit any time reductions for the programming phase. A different approach needs to be employed to have a short one horizontal time.

A global compensation scheme, whereby an entire display panel of pixels can be compensated simultaneously, can be used to separate drive transistor compensation from data programming. With a global compensation scheme, the data value is preloaded to the pixel row by row, and then then all the pixels in the display panel are compensated at the same time. Compared to a conventional row-by-row compensation scan, the control signals for a global compensation scheme are the same for each of the rows being compensated simultaneously. The use of a global compensation scheme simplifies the panel driver design and saves power consumption for the logic generation circuits.

One approach for a global compensation scheme in described in U.S. Pat. No. 8,830,219 (Choi, issued Sep. 9, 2009). In such circuit, two global control signals and a power supply ELVDD change to a state resetting all the pixels in the panel. Then the data is programmed row by row to each pixel, and global threshold compensation follows the row-by-row data programming. After global compensation, the global control signals enable the emission for all the pixels in the panel. A short one horizontal time can be achieved as the programming time is independent of the compensation time, but this scheme has a compensation mismatch between rows as the compensation time is different for each row. In particular, the first row has the longest compensation time and the last row has the shortest compensation time, and this variation can result in latter rows being inadequately compensated.

Another global compensation approach is described in U.S. Ser. No. 10/223,964 (Han, issued Mar. 5, 2019). In such configuration, data is pre-loaded to a hold capacitor in each pixel row by row by a scan signal. After the data is loaded for all the pixel on each rows, a global reset signal is applied to all the pixels, and the data stored on the hold capacitor is applied to the gate of the drive transistor in each pixel by a global writing signal. During the same time, the difference between the data voltage and the threshold voltage of drive transistor is obtained at the source of the drive transistor and stored in a storage capacitor. Then the stored voltage is applied to the gate and source of the drive transistor during the emission phase. In this way the data voltage is programmed to the pixel, and the threshold voltage of the drive transistor is compensated. The data holding time on the hold capacitor can be as long as the emission time, but the described configuration does not recognize issues associated with off-state transistor leakage. Accordingly, leakage through the described TFT components could degrade the data voltage on the hold capacitor over time. As a result, the same data voltage stored on the hold capacitors for the first row and last row (and other rows in between) could have a significant difference due to the leakage. A second issue with this scheme is the timing of the global signals, especially the voltage supplies ELVDD and ELVSS. There could be a large surging current at the supply lines when the signals for all the pixels change at the same time, and this large surge current could cause a large IR drop which undermines performance.

Another global compensation approach is described in U.S. Pat. No. 9,269,297 (Kanda, issued Feb. 23, 2016). In such configuration, data is pre-loaded to a hold capacitor in each pixel row by row by a scan signal. After the data is loaded on all the rows, two global control signals and a global emission signal change to states resetting all the pixels in the panel. Then data is transferred from the hold capacitor to the gate of the drive transistor and the threshold compensation is performed at the same time. In the latter emission phase, all the pixels emit light at the same time. The next image data is loaded to a hold capacitor in each pixel row by row again during the emission phase. In this way, there is no compensation mismatch due to compensation time differences, and there is no large supply current from the ELVDD and ELVSS. This OLED current still could be negatively affected by data leakage issues during pre-loading. The global emission signals have two pulses, one long pulse and one short pulse, and this dual pulse operation could be difficult or could require more area in the panel to generate this operation of pulses.

SUMMARY OF INVENTION

The present invention relates to pixel circuits that are capable of compensating the threshold voltage variations of the drive transistor with an ultra-short one horizontal time 1H of less than about 2 μs, which is shorter as compared to conventional configurations, with additionally removing the possible memory effects associated with the light-emitting device and the drive transistor from the previous frame. An ultra-short 1H time (<2 μs) is achieved via separation of threshold compensation of the drive transistor and data programming phases. The threshold compensation time is decided by the drive transistor characteristics and is difficult to reduce further without degrading the compensation accuracy. By separating the threshold compensation and data programming phases, a longer time can be allocated to threshold compensation for compensation accuracy while maintaining a short 1H time. As referenced above, the RC constant time required for charging the programming capacitor is determinative of the programming time, and such programming time can be reduced to ultra-short 1H times (<2 μs).

To achieve such results, a two-capacitor pixel circuit configuration is used, whereby a first capacitor is used for drive transistor threshold compensation, and a second capacitor is used to store the data voltage during a data pre-loading phase. The threshold compensation and data programming operations are independent of each other, and thus a short one horizontal time can be achieved by employing a short data programming phase. In addition, two transistors are employed to electrically connect the gate of the drive transistor to the second capacitor that stores the data voltage, wherein each transistor in this dual transistor configuration is controlled by a different control signal. A timing sequence of the different control signals is used to ensure that a mid node of the dual transistor configuration is refreshed before the data is applied to the gate of the drive transistor.

Embodiments of the present application may be operated using an external global compensation scheme, whereby data is pre-loaded row by row by a SCAN signal during a previous frame emission phase. All rows of pixels are controlled by global signals for an initialization phase, a data transfer and threshold compensation phase, and an emission phase. The threshold voltage variations of the drive transistors are compensated for all the pixels in whole panel by the external global compensation scheme.

An aspect of the invention, therefore, is a pixel circuit for a display device that employs a dual transistor configuration with a data holding capacitor to isolate the data programming phase from the compensation phase, thereby enabling a shorter 1H time as compared to conventional configurations while still achieving effective drive transistor threshold voltage compensation. In exemplary embodiments, the pixel circuit includes a drive transistor configured to control an amount of current to a light-emitting device during an emission phase depending upon a voltage applied to a gate of the drive transistor, wherein a threshold voltage of the drive transistor is compensated during a threshold compensation phase, and a first terminal of the drive transistor is electrically connected to a first power supply line during the emission phase that supplies a driving voltage; wherein the light-emitting device is electrically connected at a first node to a second terminal of the drive transistor during the emission phase, and is connected at a second node to a second power supply line; a first switch transistor and a second switch transistor that are switched by different control signals; and a data holding capacitor. The first switch transistor has a first terminal connected to the gate of the drive transistor and a second terminal connected to the second switch transistor; the second transistor has a first terminal connected to the data holding capacitor and a second terminal connected to the second terminal of the first switch transistor; and the data holding capacitor is electrically connected to a data voltage supply line during a data pre-loading phase that supplies a data voltage to pre-load the data voltage onto the data holding capacitor.

In exemplary embodiments, the pixel circuit further may include a storage capacitor and a third switch transistor, wherein the storage capacitor has a first plate connected to the first terminal of the drive transistor and a second plate connected to a first terminal of the third switch transistor, and the third switch transistor has a second terminal connected to the gate of the drive transistor and the first terminal of the first switch transistor; a fourth switch transistor having a first terminal connected to a reference voltage supply line that supplies a reference voltage and a second terminal connected to the second plate of the storage capacitor and the first terminal of the third switch transistor; a fifth switch transistor having a first terminal connected to the data voltage supply line and a second terminal connected to the data holding capacitor and the first terminal of the second switch transistor; a sixth switch transistor having a first terminal connected to an initialization voltage supply line that supplies an initialization voltage and a second terminal connected to the second terminal of the drive transistor; a seventh switch transistor having a first terminal connected to the first terminal of the light-emitting device and a second terminal connected to the second terminal of the drive transistor and the second terminal of the sixth switch transistor; and an eighth switch transistor having a first terminal connected to the first power supply line and a second terminal connected to the first terminal of the drive transistor Another aspect of the invention is a method of operating a display panel including a pixel circuit according to any of the embodiments to isolate the data programming phase from the compensation phase, thereby enabling a shorter 1H time as compared to conventional configurations while still achieving effective drive transistor threshold voltage compensation. In exemplary embodiments, the method of operating the display panel includes the steps of providing a pixel circuit according to any of the embodiments; performing a data pre-loading phase comprising electrically connecting the data holding capacitor to a data voltage supply line that supplies a data voltage to pre-load the data voltage onto the data holding capacitor; performing an initialization phase comprising electrically connecting the gate of the drive transistor and the first terminal of the first switch transistor to a reference voltage supply line that supplies a reference voltage, and electrically connecting the first terminal of the light-emitting device to an initialization voltage supply line that supplies an initialization voltage to initialization a voltage at the light-emitting device; performing a data transfer and threshold compensation phase comprising disconnecting the second plate of the storage capacitor from the gate of the drive transistor; disconnecting the first terminal of the drive transistor from the first power supply line; and placing the second switch transistor in an on state, wherein the data voltage pre-loaded onto the data holding capacitor is applied to the gate of the drive transistor, and a threshold voltage of the drive transistor is compensated by storing the threshold voltage at the first plate of the storage capacitor; and performing an emission phase during which light is emitted from the light-emitting device by electrically connecting the second terminal of the drive transistor to the first node of the light emitting device; electrically connecting the second plate of the storage capacitor to the gate of the drive transistor; and electrically connecting the first terminal of the drive transistor to the first power supply line.

Individual pixel circuits may be incorporated into a display panel that includes a pixel array comprising a plurality of individual pixel circuits arranged in "n" rows by "m" columns, and "n" and "m" are integers greater than one, wherein each of the individual pixel circuits in the pixel array is configured according to any of the embodiments. The individual pixel circuits may be controlled in accordance with a group or global compensation scheme in which global control signals are applied to multiple individual pixel circuits (up to all individual pixel circuits) of the pixel array. SCAN signals may be applied on a row by row basis to sequentially electrically connect the data holding capacitors of the individual pixel circuits to the voltage data lines on the row by row basis to pre-load a respective data voltage onto the data holding capacitors during the data pre-loading phase.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
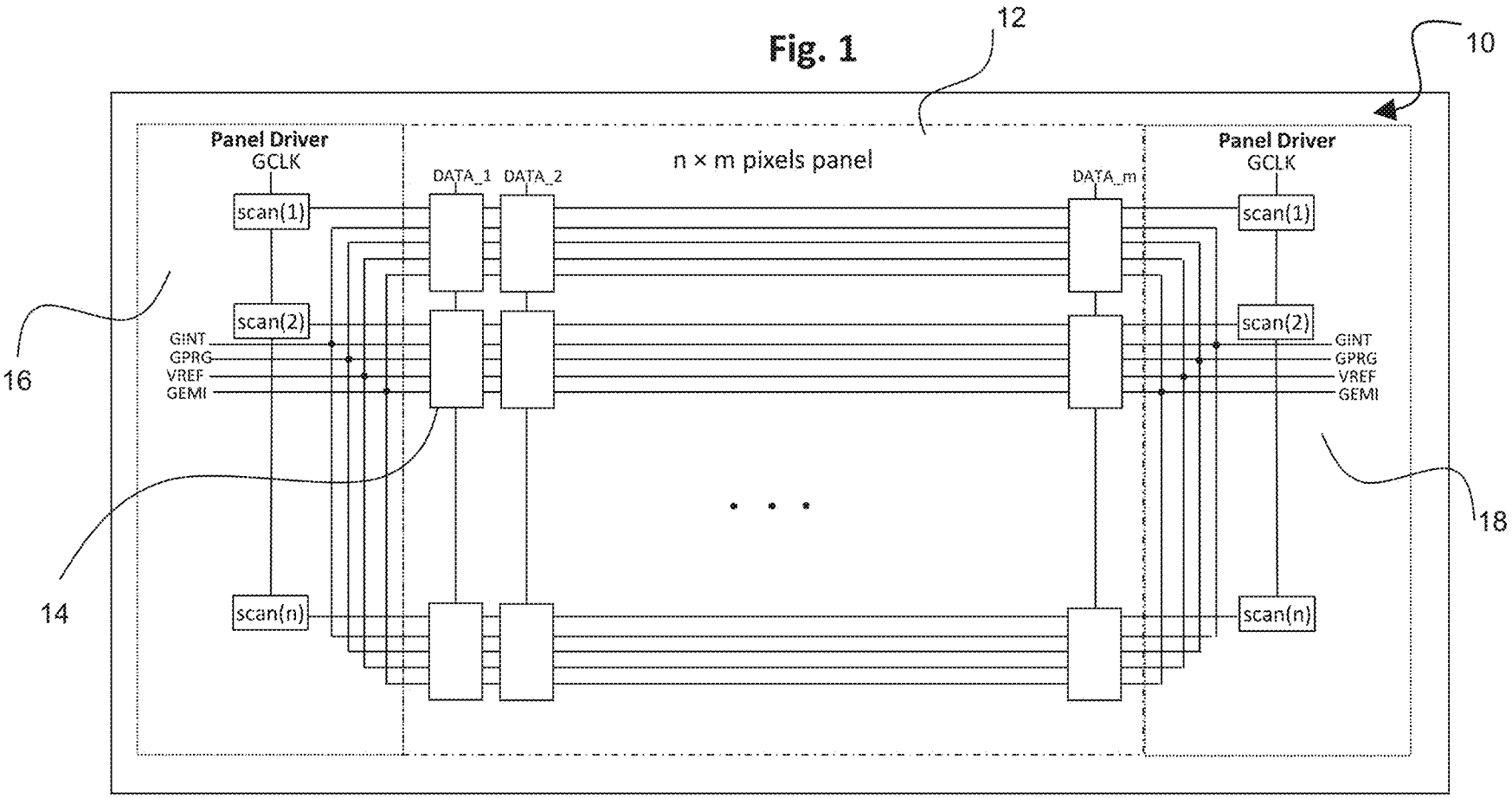
FIG. 1 is a drawing depicting a display panel with "n" rows and "m" columns of individual pixels, and a panel driver configuration that operates using a global compensation scheme.

Embodiments of the present application will now be described with reference to the drawings, wherein like reference numerals are used to refer to like elements throughout. It will be understood that the figures are not necessarily to scale.

FIG. 1 is a drawing depicting a display panel configuration 10 in accordance with embodiments of the present application. The display panel 10 includes a pixel array 12 of "n" rows and "m" columns of individual pixels 14, and panel drivers 16 and 18 located respectively on the left and right edges of the display panel 10 on opposite sides of the pixel array 12. The panel drivers 16 and 18 operate comparably as each other in applying comparable control signals as further detailed below. Multiple panel drivers are used to prevent signal degradation across the display panel, and applying control signals from panel drivers on opposite sides of the pixel array 12 ensures effective control signals are received by the individual pixels with less dependency on the location on the display panel.

Each individual pixel 14 is located at the intersection of scan control lines and data input lines. The data input lines are arranged by column, i.e., there are "m" columns of data input lines (Data_1, Data_2, . . . Data_m) associated with a corresponding "m" data signals that respectively are connected to the pixels in each column via one data line. The scan control lines are arranged by row, i.e., there are "n" rows of scan control lines (scan(1), scan(2), . . . scan(n)) associated with a corresponding "n" scan control signals that respectively are connected to the pixels in each row via one scan control line. The scan control signals perform a row selection function, whereby when a scan line in a row is enabled, the data is written from the data input lines to the pixels in that row.

Referring to the panel drivers 16 and 18, the pixels in each row are also connected to three global control signal lines, GINT, GPRG, and GEMI ("G" denoting a global control signal line) and a global reference voltage supply line, VREF, configured to implement a global compensation scheme for compensating a threshold voltage of the drive transistors of the individual pixel circuits 14 within the entire display panel 10. Accordingly, to implement a group or global compensation scheme, the global control signals are applied from the global control signal lines to multiple individual pixel circuits within the display panel 10 simultaneously, and up to all of the individual pixel circuits within the display panel 10 simultaneously.

The various control signal input lines are used to operate the individual pixels 14 in different phases. Generally, the pixels are operated in four phases, including a data pre-loading phase, an initialization phase, a combined data transfer and threshold compensation phase, and an emission phase. The data pre-loading phase of a current frame occurs during a previous frame emission phase, and commensurately during a current frame emission phase the data pre-loading phase for a next frame occurs. As further detailed below in connection with FIGS. 1 and 2, the GINT signal is enabled during the initialization phase and the data transfer and threshold compensation phase; the GPRG signal is enabled during the combined data transfer and threshold compensation phase; and the GEMI signal is enabled during the initialization phase and the emission phase (which also includes the data pre-loading phase for the next frame). The pixel circuit control during each phase is described in more detail below.

Referring back to FIG. 1, a gate clock signal input line, GCLK, from a driver integrated circuit (IC) is input to the panel drivers 16 and 18. The gate clock signal is used to generate the scan signals for each row.

Figure 2:
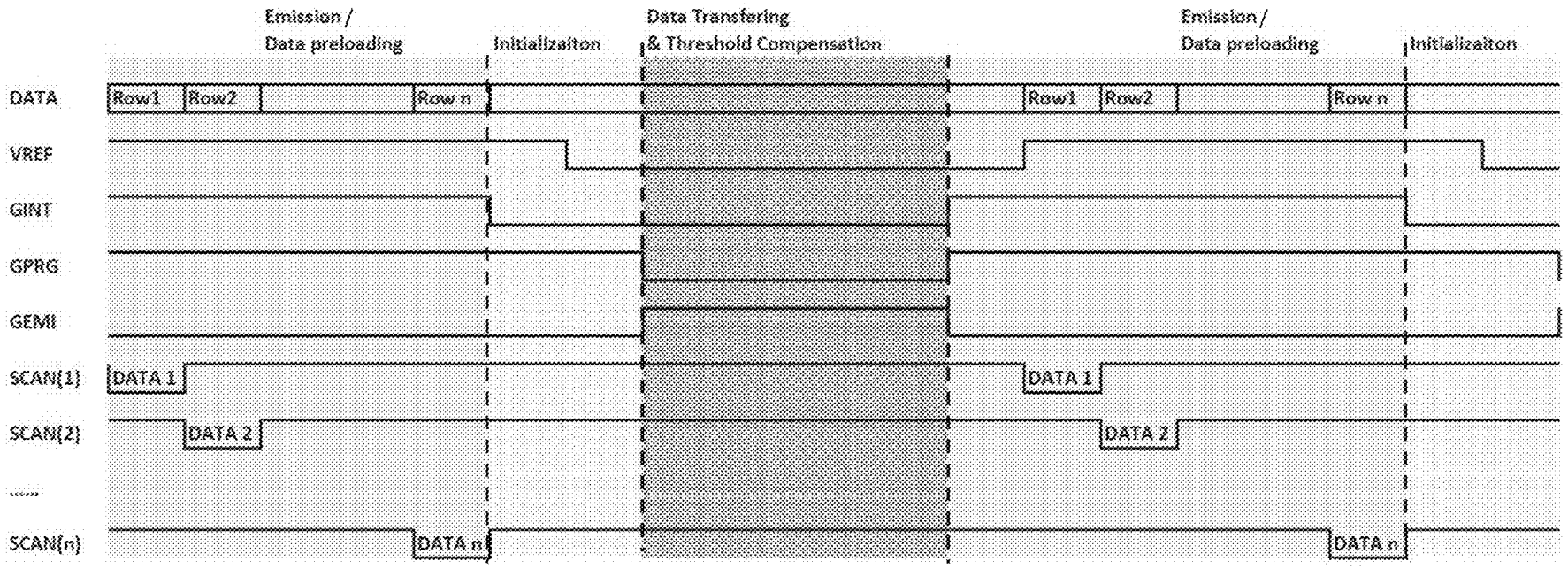
FIG. 2 is a timing diagram for global compensation that is employed in the display panel of FIG. 1.

FIG. 2 is a timing diagram for global compensation that is employed in the display panel 12 of FIG. 1. As representative, the timing diagram of FIG. 2 illustrates the scan signals SCAN, global control signals GINT, GPRG and GEMI, and the reference signal, VREF. "DATA" is the data signal that is applied to the pixel columns, and for illustration FIG. 2 shows timing for only one column data signal. In the whole panel, there are "m" columns of data signals applied respectively to the "m" columns" of pixels. In one column, there are "n" rows of pixels. "SCAN (1)" is the scan signal for the first row, "SCAN (2)" is the scan signal for the second row, and so on with "SCAN (n)" being the scan signal for an "n"th row or last row.

The display panel 10 first is operable in a data pre-loading phase during which data for the current frame is pre-loaded, which also corresponds to a previous frame emission phase. As illustrated in FIG. 2, data is preloaded during the previous frame emission phase. SCAN(1) changes from a high voltage value to a low voltage value, and the DATA line for the column writes the "DATA 1" voltage value to the pixel at the first row of the column. SCAN(1) then changes from the low voltage value to the high voltage value, and the "DATA 1" value is stored at the first row. SCAN(2) then enables the "DATA 2" value to be written and stored at the second row, and so on until the "DATA n" value for the nth (last) row is written and stored. When the data pre-loading phase ends, all the data in the frame has been written and stored in each corresponding pixel in the frame. The previous frame emission phase can still last until the designed emission time.

The display panel 10 next is operable in an initialization phase. The global signal GINT changes from a high voltage value to a low voltage value, and the pixels in the whole panel start the initialization phase. The global signal GEMI voltage level is kept low. The global signals GINT and GEMI are used to clear the data and memory effects from the previous frame and are used to set the corrected voltage conditions for next compensation phase, as further detailed below. During the initialization phase, the reference voltage signal VREF is changed from a high value to a low value to initialize the gate of the drive transistor of each pixel circuit for the next phase. GEMI next changes from the low voltage value to the high voltage value at the end of the initialization phase.

The display panel 10 next is operable in a combined data transfer and threshold compensation phase. GPRG changes from the high voltage value to the low voltage value for starting the data transfer to the drive transistor of each pixel circuit, and threshold compensation is performed as to the drive transistors for the pixels in the whole panel. At the end of the data transfer and threshold compensation phase, GINT and GPRG change from the low voltage value to the high voltage value.

The display panel 10 next is operable in an emission phase. GEMI next changes from the high voltage value to the low voltage value and starts the emission phase, during which the light-emitting device, such as an OLED, of each pixel emits light. The reference voltage VREF changes from the low voltage value to the high voltage value to be ready for the initialization phase of next frame. As referenced above and as indicated in the timing diagram of FIG. 2, the emission phase of the current frame also constitutes a data pre-loading phase as to the data for the next frame.

Details of the four phases that are globally described in connection with FIGS. 1 and 2 are further understood with the operation of such phases as to each individual pixel circuit. In accordance with embodiments of the present application, an enhanced pixel circuit configuration is provided that enables efficient operation within the global compensation and control scheme described above. In other words, the described individual pixel circuit may be incorporated into each of the individual pixels 14 within the pixel array 12 of the display panel 10. The individual pixel circuit is capable of compensating the threshold voltage variations of the drive transistor with an ultra-short one horizontal time 1H of less than about 2 μs, which is shorter as compared to conventional configurations, with additionally removing the possible memory effects associated with the light-emitting device and drive transistor from the previous frame. An ultra-short 1H time (<2 μs) is achieved via separation of threshold compensation of the drive transistor and data programming phases. The threshold compensation time is decided by the drive transistor characteristics and is difficult to reduce further without degrading the compensation accuracy. By separating the threshold compensation and data programming phases, a longer time can be allocated to threshold compensation for compensation accuracy. As referenced above, the RC constant time required for charging the programming capacitor is determinative of the programming time since data programming is performed separately for each row (whereas the compensation phase can be performed simultaneously for different rows), and such programming time can be reduced to ultra-short 1H times (<2 μs).

To achieve such results, a two-capacitor configuration is used, whereby a first capacitor is used for drive transistor threshold compensation, and a second capacitor is used to store the data voltage during the data pre-loading phase. The threshold compensation and data programming operations thus are independent of each other, and a short one horizontal time can be achieved by employing a short data programming phase. In addition, two transistors are employed to electrically connect the gate of the drive transistor to the second capacitor that stores the data voltage during the data pre-loading phase, wherein each transistor in this dual transistor configuration is controlled by a different control signal. A timing sequence of the different control signals is used to ensure that a mid node of the dual transistor configuration is refreshed before the data is applied to the gate of the drive transistor, thereby eliminating any potential memory effects of the data voltage of a previous frame.

Figure 3:
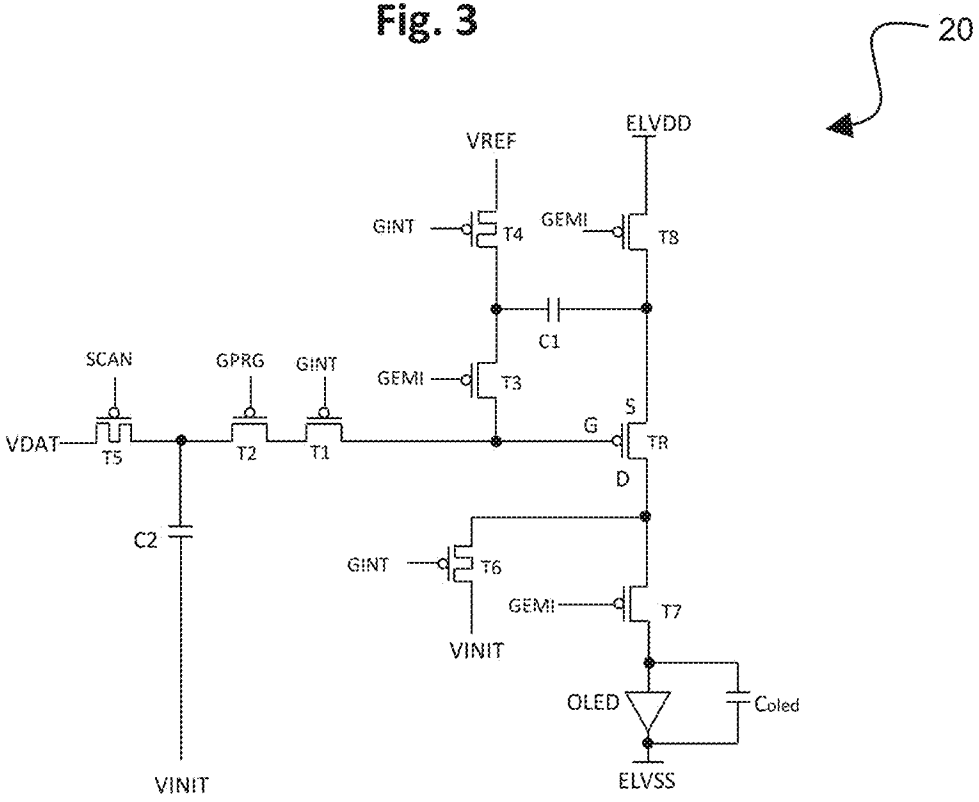
FIG. 3 is a drawing depicting a pixel circuit configuration in accordance with embodiments of the present application.
Figure 4:
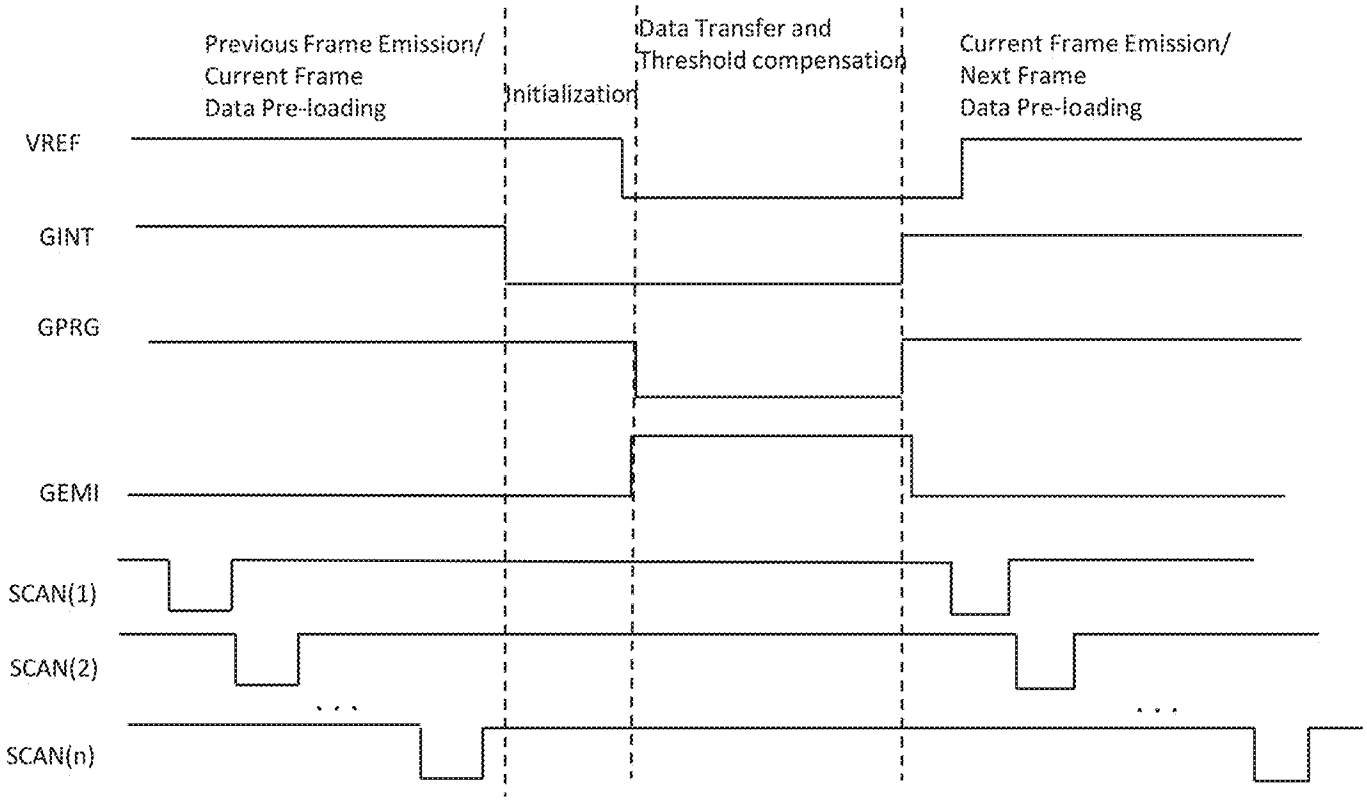
FIG. 4 is a drawing depicting a timing diagram associated with the operation of the circuit of FIG. 3.

FIG. 3 is a drawing depicting an exemplary pixel circuit of a first circuit configuration 20 in accordance with embodiments of the present application, and FIG. 4 is a timing diagram associated with the operation of the circuit configuration 20 of FIG. 3. In this example, the pixel circuit 20 is configured as a thin film transistor (TFT) circuit that includes eight p-type TFT switch transistors T1-T8, one drive transistor TR and two capacitors C1 and C2. In this exemplary embodiment, T4, T5 and T6 are double-gate TFTs, which have low leakage between the source and drain, although T4, T5, and T6 each alternatively may be a single gate TFT.

The circuit elements drive a light-emitting device, such as for example an organic light-emitting device (OLED). The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 3 depicts the pixel circuit 20 configured with multiple p-type TFTs. Transistor TR is a drive transistor that is an analogue TFT with the gate, source and drain labelled ("G", "S" and "D"), and transistors T1-T8 are digital switch TFTs. As referenced above, C1 and C2 are capacitors, with C1 also being referred to as the storage capacitor, which stores the data voltage and compensated threshold voltage, and C2 also being referred to as the data holding capacitor for storing the data voltage during the data pre-loading phase. $C_{oled}$ is the internal capacitance of the OLED device (i.e., $C_{oled}$ is not a separate component, but is inherent to the OLED). The OLED further is connected to a power supply line ELVSS as is conventional, and a driving voltage is supplied from a driving voltage supply line ELVDD as also is conventional.

The OLED and the TFT circuit 20, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 20 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, GEMI, GPRG, GINT, VDAT, VINIT and VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The light-emitting device, such as an OLED device, may be disposed over the TFT circuit. The OLED device may include a first electrode (e.g. anode of the OLED), which is connected to transistor T7 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power supply ELVSS in this example. The injection layers, transport layers, and emission layer may be organic materials, the first and second electrodes may be metals, and all of these layers may be deposited by a thermal evaporation technique.

Referring to the TFT circuit 20 of FIG. 3 in combination with the timing diagram of FIG. 4, the TFT circuit 20 operates to perform in four phases: a data pre-loading phase, an initialization phase, a combined data transfer and threshold compensation phase, and an emission phase for light emission. A global description of these phases was provided in connection with FIGS. 1 and 2 above, and the following describes the operation of such phases as to a single individual pixel circuit 20 located within the pixel array. As also referenced above, the time period for performing the programming phase is referred to in the art as the "one horizontal time" or "1H" time. A short 1H time is a requirement for displays with a large number of pixels in a column, as is necessary for high-resolution displays. As referenced above, a short one horizontal time is significant because each row must be programmed independently, whereas other operations, such as for example drive transistor threshold compensation, may be performed for multiple rows simultaneously. The responsiveness of the device, therefore, tends to be dictated most by the one horizontal time for programming.

In this embodiment, during a previous frame emission phase, the global emission control signal GEMI has a low voltage level, so transistors T3, T7 and T8 are on. With transistor T3 being on, the storage capacitor C1 is connected at a first plate to the source of the drive transistor, and is electrically connected at a second plate to the gate of the drive transistor through T3. With transistors T7 and T8 being on, the light emission is being driven by the driving voltage from the power supply line ELVDD being electrically connected to the drive transistor TR, whereby the actual current applied to the OLED is determined by the voltage at the gate of the drive transistor. The global control signal GINT has a high voltage, so transistors T1, T4 and T6 are off. The global control signal GPRG has a high voltage, so transistor T2 is off. With transistors T1 and T2 being off, the data holding capacitor C2 is electrically isolated from the rest of the pixel circuit. As described above in connection with FIGS. 1 and 2, to implement a group or global compensation scheme, the global control signals, GINT, GPRG and GEMI and the reference voltage VREF, are applied to multiple individual pixel circuits in the display panel simultaneously, up to all the pixels in the display panel simultaneously, with FIGS. 3 and 4 pertaining to the operation of such global signals as to an individual pixel circuit within the pixel panel.

The circuit 20 first is operable in a data pre-loading phase for the current frame, which occurs during a previous frame emission phase. In other words, during the data pre-loading phase all the pixels in the pixel panel emit light based on data voltages previously applied, while simultaneously the data voltages for the current frame are loaded to each pixel row by row. Transistor T5 is connected at a first terminal to a data voltage supply line VDAT that supplies the data voltage to pixel circuit 20, and at a second terminal to a first (top) plate of the data holding capacitor C2. A first row scan signal, SCAN(1), is changed from a high voltage value to a low voltage value, causing the transistor T5 to be turned on. Turning on T5 electrically connects the data holding capacitor C2 to the data voltage supply line VDAT for supplying the data voltage. The data voltage VDAT thus is applied at the first plate of the data holding capacitor C2 through T5. The second plate of the programming capacitor C2 is connected to an initialization voltage supply line, VINIT, which may be any fixed voltage supply available for the pixel, such as ELVDD, or a dedicated voltage. The data voltage VDAT is changed from the value for the pixel of the previous row of the display, or the last row from the previous frame or a previous value if the row being programmed is a first row, to the data value for the current pixel of the current row, which is applied to the data holding capacitor C2.

As the data holding capacitor is electrically isolated from the rest of the pixel by transistors T1 and T2 being in an off state during the data pre-loading phase, the data voltage stored at the data holding capacitor C2 does not affect the current emission of the pixel, which is significant as the data pre-loading phase for the current frame occurs at the same time as emission relative to the previous frame data value. At the end of the data pre-loading phase, the first row scan signal SCAN(1) is changed from the low voltage value to the high voltage value, causing the transistor T5 to be turned off. With T5 turning off, the first plate of the data holding capacitor C2 is disconnected from the data voltage supply line VDAT, and the data value remains stored on the data holding capacitor C2.

As seen in the timing diagram of FIG. 4, the second row scan signal SCAN(2) next is enabled to program the data for the pixels for the second row in comparable manner as described above with respect to the first row. The data is programmed row by row until the last row scan signal SCAN(n) is enabled to program the last row "n". In this manner, the SCAN signals are applied on a row by row basis to sequentially electrically connect the data holding capacitors of the individual pixel circuits to the voltage data lines on the row by row basis, and more particularly the electrical connection is through the fifth switch transistors, to pre-load a respective data voltage onto the data holding capacitors during the data pre-loading phase. When all the data for the frame has been programmed and stored in all the pixels in the panel on such row-by-row basis, the data pre-loading phase ends.

As referenced above, the data pre-loading phase for the current frame occurs during the previous frame emission phase. The data pre-loading phase can start immediately after the start of the previous frame emission phase or with some delay, although the data pre-loading phase should end before the end of the previous frame emission phase. Relatedly, the previous frame emission phrase may extend for any suitable duration after the data pre-loading phase for the current frame ends.

After the previous frame emission phase including the data pre-loading phase of the current frame ends, the pixels next are operable in the initialization phase, whereby all pixels in the display panel are refreshed and readied for subsequent data transferring from the data holding capacitor C2 to the storage capacitor C1, and readied for threshold compensation for the drive transistor. Referring again to the timing diagram of FIG. 4 in connection with the pixel circuit configuration of FIG. 3, at the beginning of the initialization phase, the global control signal GINT signal level is changed from a high voltage value to a low voltage value, and transistors T1, T4 and T6 are turned on. With T4 being turned on, the gate of the drive transistor TR is electrically connected to a reference voltage supply line that supplies a reference voltage VREF through T4 and through transistor T3, which remains in the on state as the GEMI signal remains low during the initialization phase. With T1 also being turned on, the reference voltage VREF is also applied through T4, T3, and T1 to a mid-point node at which transistors T1 and T2 are connected. At the beginning of the initialization phase, VREF is set to a high voltage that is equal to or greater than ELVDD, and thus the drive transistor is turned off by VREF. Accordingly, there is no current flowing through the drive transistor when a low initialization voltage VINT is applied to the drain of the drive transistor through T6. With T6 being turned on, the drain of the drive transistor is electrically connected to VINIT. As T7 is kept on by the low GEMI signal during the initialization phase, the initialization voltage also is applied to the anode of the light-emitting device. Next towards the end of the initialization phase, the VREF signal is changed from a high voltage to a low voltage value to initialize the gate voltage of the drive transistor for next phase of data transferring and threshold compensation. As a result, voltages and memory effects from the previous frame are cleared from the light-emitting device and the drive transistor gate by operation of the initialization phase.

The TFT circuit 20 next is operable in a combined data transfer and threshold compensation phase. During this phase, the data voltage stored on the data holding capacitor C2 from the previous data pre-loading phase is transferred to the storage capacitor C1, and the threshold voltage of the drive transistor TR is compensated. For such phase, the global emission signal GEMI level is changed from a low voltage value to a high voltage value, and thus transistors T3, T7 and T8 are turned off. With T3 being turned off, the second plate of the storage capacitor C1 is electrically disconnected from the gate of the drive transistor but still remains electrically connected to the reference voltage supply line VREF through T4, which remains on. With T7 being turned off, the anode of the light-emitting device is electrically disconnected from the drain of the drive transistor to electrically isolate the light-emitting device from the other components of the pixel circuit. With T8 being turned off, the source of the drive transistor is electrically disconnected from the power supply line ELVDD and the source of the drive transistor is floating.

Additionally during the combined data transfer and threshold compensation phase, the global control signal GPRG level is changed from a high voltage to a low voltage, and transistor T2 is turned on. With T2 turning on and T3 remaining on from the previous initialization phase, the data voltage stored on the data holding (second) capacitor C2 is applied to the gate of the drive transistor through transistors T2 and T1. The voltage at the first plate of the storage (first) capacitor C1 and at the source of the drive transistor is pulled down from the initial voltage ELVDD until this voltage reaches the level of $V_{DAT}+|V_{TH}|$, where $V_{TH}$ is the threshold voltage of the drive transistor. In this manner, both the threshold voltage of the drive transistor and the data voltage effectively are stored on the storage capacitor C1.

Preferably, to have effective voltage threshold compensation of the drive transistor TR, the initial voltage difference between the source of the drive transistor, initially ELVDD, and the voltage at the gate of the drive transistor, currently VDAT, should satisfy the following condition:

$$V_{ELVDD}-V_{DAT}>|V_{TH}|+\Delta V,$$

$$V_{DAT}<V_{ELVDD}-|V_{TH}|\Delta V$$

where ΔV is a voltage that is large enough to generate a high initial current to charge the storage capacitor within an allocated threshold compensation time. The value of ΔV will depend on the properties of the transistors. For example, ΔV would be at least 3 volts for exemplary low-temperature polycrystalline silicon thin film transistor processes.

At the end of the combined data transfer and threshold compensation phase, the group control signal GPRG level is changed from the low voltage to the high voltage, causing transistor T2 to be turned off. As T2 is turned off, the gate of the drive transistor is electrically disconnected from the data holding capacitor C2. The global control signal GINT level is changed from the low voltage to the high voltage, causing transistors T1, T4, and T6 to be turned off. As T1 is turned off, the gate of the drive transistor is electrically disconnected from the transistor T2, and the gate of the drive transistor is electrically isolated by transistors T1 and T2 from the data holding capacitor C2. As T4 is turned off, the second plate of the storage capacitor C1 is electrically disconnected from the reference voltage supply line VREF. As T6 is turned off, the drain of the drive transistor is electrically disconnected from the initialization voltage VINIT.

The TFT circuit 20 next is operable in an emission phase during which the light-emitting device is capable of emitting light. The group emission signal, GEMI, is changed from the high voltage value to the low voltage value, causing transistors T3, T7 and T8 to be turned on. As the transistor T3 is turned on, the gate of the drive transistor and the second plate of the storage capacitor C1 are electrically connected with the voltage of the second plate of the storage capacitor C1 being VREF (low voltage value), and the first plate of the storage capacitor C1 being $V_{DAT}+|V_{TH}|$.

As transistor T8 is turned on, the source of the drive transistor and the first plate of the storage capacitor C1 are electrically connected to the power supply line ELVDD. The voltage at the second plate of the capacitor C1 and the gate of the drive transistor becomes:

$$V_{REF_LOW}+V_{ELVDD}-(V_{DAT}|V_{TH}|)$$

As transistor T7 is turned on, the drain of the drive transistor is electrically connected to the anode of the OLED. The current that flows through the OLED is:

$$I_{OLED} = \frac{\beta}{2}(V_{REF_LOW} + V_{ELVDD} - (V_{DAT} + |V_{TH}|) - V_{ELVDD} - V_{TH})^2$$
$$= \frac{\beta}{2}(V_{REF_LOW} - V_{DAT})^2$$

where $$\beta = \mu_n \cdot C_{ox} \cdot \frac{W}{L};$$

$C_{ox}$ is the capacitance of the drive transistor gate oxide;
W is the width of the drive transistor channel;
L is the length of the drive transistor channel (i.e. distance between source and drain); and
$\mu_n$ is the carrier mobility of the drive transistor.

Accordingly, the current to the OLED does not depend on the threshold voltage of the drive transistor TR, and hence the current to the OLED device $I_{OLED}$ is not affected by the threshold voltage variations of the drive transistor. In this manner, variation in the threshold voltage of the drive transistor has been compensated.

Insofar as the emission phase of the current frame and the data-preloading phase for the next frame overlap, at a given point in time during the emission phase the reference voltage VREF is changed from the low voltage to the high voltage to ready the pixel circuit for next data pre-loading phase as to the next frame. The data-preloading phase for the next frame thus starts and ends within the emission phase of the current frame comparably as described above in connection with the data pre-loading phase of the current frame.

A short one horizontal time (1H) is achieved by employing the data pre-loading phase, during which the data voltage VDAT effectively is programmed onto the data holding second capacitor C2 during a previous frame emission phase. In this manner, data programming is isolated from the subsequent threshold compensation of the drive transistor to permit reduction of the 1H time. With the data voltage already being programmed to the data holding capacitor C2, the data voltage is readily transferred from the data holding capacitor C2 to the storage capacitor C1 during threshold voltage compensation of the drive transistor. To permit such operation, the two transistors T1 and T2 are employed to electrically connect the gate of the drive transistor to the data holding capacitor C2 that stores the data voltage, with each transistor T1 and T2 in this dual transistor configuration being controlled by a different control signal. A timing sequence of the different control signals is used to ensure that the mid node of the dual transistor configuration of T1 and T2 is refreshed before the data is applied to the gate of the drive transistor. In this manner, potential memory effects of a data voltage from a previous frame are eliminated. In addition, the dual transistor configuration of T1 and T2 operates in combination comparably as a double gate transistor, which results in reduced leakage from the data holding capacitor C2 during threshold compensation that otherwise could negatively affect the stored data voltage.

The pixel circuit 20 operated as described above has advantages over conventional configurations. As referenced above, the pixel circuit is capable of compensating the threshold voltage variations of the drive transistor while maintaining an ultra-short data programming one horizontal time 1H of less than about 2 μs, which is shorter as compared to conventional configurations, with additionally removing the possible memory effects associated with the OLED device and drive transistor from the previous frame. This is achieved by using the two-capacitor configuration to separate the threshold compensation and data programming phases, in combination with the dual transistor configuration of T1 and T2 to apply the data voltage to the gate of the drive transistor. Such operation results in a longer time that can be allocated to threshold compensation for compensation accuracy while maintaining the ultra-short 1H time.

The enhanced pixel circuit configuration also enables efficient operation within the global compensation and control scheme described above, and further power saving is achieved by the global compensation scheme. Referring to the display panel operation of FIGS. 1 and 2 in combination with the individual pixel circuit operation of FIGS. 3 and 4, GINT, GPRG and GEMI are common global control signals that are applied to multiple pixel rows simultaneously, up to all pixels in the display panel simultaneously. This in particular permits the initialization phase, the combined data transfer and threshold compensation phase, and the emission phase to be performed simultaneously for multiple individual pixel circuits, and up to all individual pixel circuits in the display panel, as illustrated for example in the timing diagram of FIG. 2. The data pre-loading phase includes sequentially enabling the SCAN signal to the pixel array row by row of the next frame simultaneously with the emission phase of the current frame to provide for a more efficient data programming operation.

The enhanced pixel circuit configuration also is immune from power supply variations, such as an IR drop from the voltage supply lines. During the data transfer and threshold compensation phase, the stored voltage across the storage capacitor is only related to the data voltage VDAT, the threshold voltage of the drive transistor $V_{TH}$, and the reference voltage VREF. As the reference voltage supply does not supply current to the pixel as the power supply ELVDD supplies the driving voltage, the IR drop is much more reduced for the reference voltage supply line. During the emission phase, as the storage capacitor C1 is electrically connected between to the gate of the drive transistor and to the driving voltage supply line ELVDD, any voltage variations at the driving voltage supply line will be followed by the gate of the drive transistor. In effect, the gate-source voltage change of the drive transistor is not affected by the driving voltage variations.

An aspect of the invention, therefore, is a pixel circuit for a display device that employs a dual transistor configuration with a data holding capacitor to isolate the data programming phase from the compensation phase, thereby enabling a shorter 1H time as compared to conventional configurations while still achieving effective drive transistor threshold voltage compensation. In exemplary embodiments, the pixel circuit includes a drive transistor configured to control an amount of current to a light-emitting device during an emission phase depending upon a voltage applied to a gate of the drive transistor, wherein a threshold voltage of the drive transistor is compensated during a threshold compensation phase, and a first terminal of the drive transistor is electrically connected to a first power supply line during the emission phase that supplies a driving voltage; wherein the light-emitting device is electrically connected at a first node to a second terminal of the drive transistor during the emission phase, and is connected at a second node to a second power supply line; a first switch transistor and a second switch transistor that are switched by different control signals; and a data holding capacitor. The first switch transistor has a first terminal connected to the gate of the drive transistor and a second terminal connected to the second switch transistor; the second transistor has a first terminal connected to the data holding capacitor and a second terminal connected to the second terminal of the first switch transistor; and the data holding capacitor is electrically connected to a data voltage supply line during a data pre-loading phase that supplies a data voltage to pre-load the data voltage onto the data holding capacitor. The pixel circuit may include one or more of the following features, either individually or in combination.

In an exemplary embodiment of the pixel circuit, the pixel circuit further includes a storage capacitor and a third switch transistor, wherein the storage capacitor has a first plate connected to the first terminal of the drive transistor and a second plate connected to a first terminal of the third switch transistor, and the third switch transistor has a second terminal connected to the gate of the drive transistor and the first terminal of the first switch transistor.

In an exemplary embodiment of the pixel circuit, the pixel circuit further includes a fourth switch transistor having a first terminal connected to a reference voltage supply line that supplies a reference voltage and a second terminal connected to the second plate of the storage capacitor and the first terminal of the third switch transistor.

In an exemplary embodiment of the pixel circuit, the pixel circuit further includes a fifth switch transistor having a first terminal connected to the data voltage supply line and a second terminal connected to the data holding capacitor and the first terminal of the second switch transistor.

In an exemplary embodiment of the pixel circuit, the pixel circuit further includes a sixth switch transistor having a first terminal connected to an initialization voltage supply line that supplies an initialization voltage and a second terminal connected to the second terminal of the drive transistor; a seventh switch transistor having a first terminal connected to the first node of the light-emitting device and a second terminal connected to the second terminal of the drive transistor and the second terminal of the sixth switch transistor; and an eighth switch transistor having a first terminal connected to the first power supply line and a second terminal connected to the first terminal of the drive transistor.

In an exemplary embodiment of the pixel circuit, the switch transistors are p-type transistors.

In an exemplary embodiment of the pixel circuit, the light-emitting device is one of an organic light-emitting diode, a micro light-emitting diode (LED), or a quantum dot LED.

Another aspect of the invention is a display panel that incorporates an array of individual pixels circuits with a group or global compensation scheme. In exemplary embodiments, the display panel includes a pixel array comprising a plurality of individual pixel circuits arranged in "n" rows by "m" columns, and "n" and "m" are integers greater than one, wherein each of the individual pixel circuits in the pixel array is configured according to any of the embodiments; a common global emission control signal line GEMI that supplies a global emission control signal to multiple individual pixel circuits of the pixel array; a common global initialization control signal line GINT that supplies a global initialization control signal to multiple individual pixel circuits of the pixel array; and a common global programming control signal GPRG that supplies a global programming control signal to multiple individual pixel circuits the pixel array. The display panel may include one more of the following features, either individually or in combination.

In an exemplary embodiment of the display panel, the common global initialization control signal line GINT supplies the global initialization control signal to the first switch transistors of multiple individual pixel circuits of the pixel array; and the common global programming control signal GPRG supplies the global programming control signal to the second switch transistors of multiple pixel circuits the pixel array.

In an exemplary embodiment of the display panel, the common global emission control signal line GEMI supplies the global emission control signal to the third switch transistors of multiple individual pixel circuits of the pixel array; the common global initialization control signal line GINT supplies the global initialization control signal to the first and fourth switch transistors of multiple individual pixel circuits of the pixel array; and the common global programming control signal GPRG supplies the global programming control signal to the second switch transistors of multiple individual pixel circuits the pixel array.

In an exemplary embodiment of the display panel, the common global emission control signal line GEMI supplies the global emission control signal to the third, seventh, and eighth switch transistors of multiple individual pixel circuits of the pixel array; the common global initialization control signal line GINT supplies the global initialization control signal to the first, fourth, and sixth switch transistors of multiple individual pixel circuits of the pixel array; and the common global programming control signal GPRG supplies the global programming control signal to the second switch transistors of multiple individual pixel circuits the pixel array.

In an exemplary embodiment of the display panel, the display panel further includes scan control signal lines SCAN that supply scan signals to the pixel array, wherein the scan signals are supplied on a row by row basis to sequentially electrically connect the data holding capacitors in each of the individual pixel circuits on the row by row basis to the data voltage lines to pre-load a respective data voltage onto the data holding capacitors during the data pre-loading phase.

In an exemplary embodiment of the display panel, the display panel further includes scan control signal lines SCAN that supply scan signals to the fifth switch transistors of the individual pixel circuits of the pixel array, wherein the scan signals are supplied on a row by row basis to sequentially electrically connect the data holding capacitors in each of the individual pixel circuits on the row by row basis to the data voltage supply lines to pre-load a respective data voltage onto the data holding capacitors during the data pre-loading phase.

In an exemplary embodiment of the display panel, the display panel further includes a common global reference voltage supply line VREF that supplies a reference voltage to the pixel array.

Another aspect of the invention is a method of operating a display panel including a pixel circuit according to any of the embodiments to isolate the data programming phase from the compensation phase, thereby enabling a shorter 1H time as compared to conventional configurations while still achieving effective drive transistor threshold voltage compensation. In exemplary embodiments, the method of operating the display panel includes the steps of providing a pixel circuit according to any of the embodiments; performing a data pre-loading phase comprising electrically connecting the data holding capacitor to a data voltage supply line that supplies a data voltage to pre-load the data voltage onto the data holding capacitor; performing an initialization phase comprising electrically connecting the gate of the drive transistor and the first terminal of the first switch transistor to a reference voltage supply line that supplies a reference voltage, and electrically connecting the first terminal of the light-emitting device to an initialization voltage supply line that supplies an initialization voltage to initialization a voltage at the light-emitting device; performing a data transfer and threshold compensation phase comprising disconnecting the second plate of the storage capacitor from the gate of the drive transistor; disconnecting the first terminal of the drive transistor from the first power supply line; and placing the second switch transistor in an on state, wherein the data voltage pre-loaded onto the data holding capacitor is applied to the gate of the drive transistor, and a threshold voltage of the drive transistor is compensated by storing the threshold voltage at the first plate of the storage capacitor; and performing an emission phase during which light is emitted from the light-emitting device by electrically connecting the second terminal of the drive transistor to the first node of the light emitting device; electrically connecting the second plate of the storage capacitor to the gate of the drive transistor; and electrically connecting the first terminal of the drive transistor to the first power supply line. The method of operating a display panel may include one or more of the following features, either individually or in combination.

In an exemplary embodiment of the method of operating a display panel, the initialization phase further comprises applying the reference voltage to a mid node connection between the first switch transistor and the second switch transistor.

In an exemplary embodiment of the method of operating a display panel, the initialization phase and the emission phase further comprise placing the third transistor in an on state to electrically connect the second plate of the storage capacitor to the gate of the drive transistor through the third switch transistor.

In an exemplary embodiment of the method of operating a display panel, the initialization phase further comprises placing the third switch transistor and the fourth switch transistor in an on state to apply the reference voltage to the gate of the drive transistor through the third and fourth switch transistors, and to apply the reference voltage to the mid node connection between the first switch transistor and the second switch transistor through the third, fourth, and first switch transistors.

In an exemplary embodiment of the method of operating a display panel, the data pre-loading phase further comprises placing the fifth switch transistor in an on state to electrically connect the data holding capacitor to the data voltage supply line to pre-load the data voltage onto the data holding capacitor.

In an exemplary embodiment of the method of operating a display panel, the initialization phase further comprises placing the sixth switch transistor in an on state to electrically connect the first terminal of the light-emitting device to the initialization voltage supply line through the sixth switch transistor to initialize the voltage at the light-emitting device.

In an exemplary embodiment of the method of operating a display panel, the initialization phase further comprises placing the seventh switch transistor in an on state to electrically connect the first terminal of the light-emitting device to the initialization voltage supply line through the sixth and seventh switch transistors to initialize the voltage at the light-emitting device; and the emission phase further comprises placing the seventh and eight switch transistors in an on state to electrically connect the first terminal of the light-emitting device to the first power supply line through the eighth switch transistor, the drive transistor, and the seventh switch transistor.

In an exemplary embodiment of the method of operating a display panel, the data pre-loading phase of a current frame occurs during the emission phase of a previous frame.

In an exemplary embodiment of the method of operating a display panel, the reference voltage changes from a first voltage value to a second voltage value at the end of the initialization phase, and changes from the second voltage value to the first voltage value during the emission phase In an exemplary embodiment of the method of operating a display panel, the method further includes arranging a plurality of individual pixel circuits according to any of the embodiments in a pixel array of "n" rows by "m" columns wherein "n" and "m" are integers greater than one; applying a common global emission control signal GEMI to multiple individual pixel circuits of the pixel array during the initialization and emission phases; applying a common global initialization control signal GINT to multiple individual pixel circuits of the pixel array during the initialization and data transfer and programming phases; and applying a common global programming control signal GPRG to multiple individual pixel circuits of the pixel array during the data transfer and programming phase.

In an exemplary embodiment of the method of operating a display panel, the method further includes applying the common global initialization control signal GINT to the first switch transistors of multiple individual pixel circuits of the pixel array during the initialization and data transfer and programming phases; and applying the common global programming control signal GPRG to the second switch transistors of multiple individual pixel circuits of the pixel array during the data transfer and programming phase.

In an exemplary embodiment of the method of operating a display panel, the common global initialization control signal GINT is applied to the first and fourth switch transistors of multiple individual pixel circuits of the pixel array during the initialization and data transfer and programming phases; the common global emission control signal GEMI is applied to the third switch transistors of multiple individual pixel circuits of the pixel array during the initialization and emission phases; and the common global programming control signal GPRG is applied to the second switch transistors of multiple individual pixel circuits of the pixel array during the data transfer and programming phase.

In an exemplary embodiment of the method of operating a display panel, the common global initialization control signal GINT is applied to the first, fourth, and sixth switch transistors of multiple individual pixel circuits of the pixel array during the initialization and data transfer and programming phases; the common global emission control signal GEMI is applied to the third, seventh, and eighth switch transistors of multiple individual pixel circuits of the pixel array during the initialization and emission phases; and the common global programming control signal GPRG is applied to the second switch transistors of multiple individual pixel circuits of the pixel array during the data transfer and programming phase.

In an exemplary embodiment of the method of operating a display panel, the method further includes applying a SCAN signal to each row of the pixel array, wherein the SCAN signals are applied on a row by row basis to sequentially electrically connect the data holding capacitors of the individual pixel circuits to the voltage data lines on the row by row basis to pre-load a respective data voltage onto the data holding capacitors during the data pre-loading phase.

In an exemplary embodiment of the method of operating a display panel, the method further includes applying SCAN signals to the fifth transistors of each row of the pixel array, wherein the SCAN signals are applied on a row by row basis to sequentially electrically connect the data holding capacitors of the individual pixel circuits to the voltage data lines on the row by row basis to pre-load a respective data voltage onto each of the data holding capacitors during the data pre-loading phase.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—display panel configuration
12—pixel array
14—individual pixels
16—first panel driver
18—second panel driver
20—pixel circuit configuration
T1-T8—multiple TFT switch transistors
TR—analogue TFT drive transistor
OLED—organic light emitting diode (or generally light-emitting device)
C1—storage capacitor
C2—data holding capacitor
$C_{oled}$—internal capacitance of OLED
VDAT—data voltage supply and supply line
ELVDD—driving voltage supply and supply line
ELVSS—OLED power supply and supply line
VINIT—initialization voltage supply and supply line
VREF—reference voltage supply and supply line
SCAN—row control signals
GINT/GPRG/GEMI—group or global control signals

What is claimed is:

1. A display panel comprising:

a pixel array comprising a plurality of individual pixel circuits arranged in "n" rows by "m" columns, and "n" and "m" are integers greater than one, wherein each of the individual pixel circuits in the pixel array comprises:

a drive transistor configured to control an amount of current to a light-emitting device during an emission phase depending upon a voltage applied to a gate of the drive transistor, wherein a threshold voltage of the drive transistor is compensated during a threshold compensation phase, and a first terminal of the drive transistor is electrically connected to a first power supply line during the emission phase that supplies a driving voltage;

wherein the light-emitting device is electrically connected at a first node to a second terminal of the drive transistor during the emission phase, and is connected at a second node to a second power supply line;

a first switch transistor and a second switch transistor that are switched by different control signals;

a data holding capacitor;

wherein:

the first switch transistor has a first terminal directly connected to the gate of the drive transistor and a second terminal connected to the second switch transistor;

the second switch transistor has a first terminal connected to the data holding capacitor and a second terminal connected to the second terminal of the first switch transistor; and the data holding capacitor is electrically connected to a data voltage supply line during a data pre-loading phase that supplies a data voltage to pre-load the data voltage onto the data holding capacitor;

a storage capacitor and a third switch transistor, wherein the storage capacitor has a first plate connected to the first terminal of the drive transistor and a second plate connected to a first terminal of the third switch transistor, and the third switch transistor has a second terminal connected to the pate of the drive transistor and the first terminal of the first switch transistor;

a fourth switch transistor having a first terminal connected to a reference voltage supply line that supplies a reference voltage and a second terminal connected to the second plate of the storage capacitor and the first terminal of the third switch transistor;

a fifth switch transistor having a first terminal connected to the data voltage supply line and a second terminal connected to the data holding capacitor and the first terminal of the second switch transistor;

a sixth switch transistor having a first terminal connected to an initialization voltage supply line that supplies an initialization voltage and a second terminal connected to the second terminal of the drive transistor;

a seventh switch transistor having a first terminal connected to the first node of the light-emitting device and a second terminal connected to the second terminal of the drive transistor and the second terminal of the sixth switch transistor; and an eighth switch transistor having a first terminal connected to the first power supply line and a second terminal connected to the first terminal of the drive transistor;

a common global emission control signal line GEMI that supplies a global emission control signal to the third, seventh, and eighth switch transistors of multiple individual pixel circuits of the pixel array;

a common global initialization control signal line GINT that supplies a global initialization control signal to the first, fourth, and sixth switch transistors of multiple individual pixel circuits of the pixel array; and a common global programming control signal GPRG that supplies a global programming control signal to the second switch transistors of multiple individual pixel circuits the pixel array.

2. The display panel of claim 1, further comprising scan control signal lines SCAN that supply scan signals to the pixel array, wherein the scan signals are supplied on a row by row basis to sequentially electrically connect the data holding capacitors in each of the individual pixel circuits on the row by row basis to the data voltage lines to pre-load a respective data voltage onto the data holding capacitors during the data pre-loading phase.

3. The display panel of claim 1, further comprising a common global reference voltage supply line VREF that supplies a reference voltage to the pixel array.

4. A method of operating a display panel comprising the steps of:

providing an individual pixel circuit comprising:

a drive transistor configured to control an amount of current to a light-emitting device during an emission phase depending upon a voltage applied to a gate of the drive transistor, and a first terminal of the drive transistor is electrically connected to a first power supply line during the emission phase that supplies a driving voltage;

wherein the light-emitting device is electrically connected at a first node to a second terminal of the drive transistor during the emission phase, and at a second node to a second power supply line;

a first switch transistor and a second switch transistor that are switched by different control signals, and a data holding capacitor and a storage capacitor;

wherein the first switch transistor has a first terminal connected to the gate of the drive transistor and a second terminal connected to the second switch transistor; the second transistor has a first terminal connected to the data holding capacitor and a second terminal connected to the second terminal of the first switch transistor; and the storage capacitor has a first plate connected to the first terminal of the drive transistor and a second plate that is electrically connectable to the gate of the drive transistor;

performing a data pre-loading phase comprising electrically connecting the data holding capacitor to a data voltage supply line that supplies a data voltage to pre-load the data voltage onto the data holding capacitor;

performing an initialization phase comprising electrically connecting the gate of the drive transistor and the first terminal of the first switch transistor to a reference voltage supply line that supplies a reference voltage, and electrically connecting the first terminal of the light-emitting device to an initialization voltage supply line that supplies an initialization voltage to initialization a voltage at the light-emitting device;

performing a data transfer and threshold compensation phase comprising disconnecting the second plate of the storage capacitor from the gate of the drive transistor; disconnecting the first terminal of the drive transistor from the first power supply line; and placing the second switch transistor in an on state, wherein the data voltage pre-loaded onto the data holding capacitor is applied to the gate of the drive transistor, and a threshold voltage of the drive transistor is compensated by storing the threshold voltage at the first plate of the storage capacitor; and performing an emission phase during which light is emitted from the light-emitting device by electrically connecting the second terminal of the drive transistor to the first node of the light emitting device; electrically connecting the second plate of the storage capacitor to the gate of the drive transistor; and electrically connecting the first terminal of the drive transistor to the first power supply line.

5. The method of operating a display panel of claim 4, wherein the initialization phase further comprises applying the reference voltage to a mid node connection between the first switch transistor and the second switch transistor.

6. The method of operating a display panel of claim 4, wherein the individual pixel circuit further comprises a third switch transistor having a first terminal connected to the second plate of the storage capacitor and a second terminal connected to the gate of the drive transistor and the first terminal of the first switch transistor; and the initialization phase and the emission phase further comprise placing the third transistor in an on state to electrically connect the second plate of the storage capacitor to the gate of the drive transistor through the third switch transistor.

7. The method of operating a display panel of claim 6, wherein the individual pixel circuit further comprises a fourth switch transistor having a first terminal connected to the reference voltage supply line and a second terminal connected to the second plate of the storage capacitor and the first terminal of the third switch transistor; and the initialization phase further comprises placing the third switch transistor and the fourth switch transistor in an on state to apply the reference voltage to the gate of the drive transistor through the third and fourth switch transistors, and to apply the reference voltage to the mid node connection between the first switch transistor and the second switch transistor through the third, fourth, and first switch transistors.

8. The method of operating a display panel of claim 7, wherein the individual pixel circuit further comprises a fifth switch transistor having a first terminal connected to the data voltage supply line and a second terminal connected to the data holding capacitor and the first terminal of the second switch transistor; and the data pre-loading phase further comprises placing the fifth switch transistor in an on state to electrically connect the data holding capacitor to the data voltage supply line to pre-load the data voltage onto the data holding capacitor.

9. The method of operating a display panel of claim 8, wherein the individual pixel circuit further comprises a sixth switch transistor having a first terminal connected to the initialization voltage supply line and a second terminal connected to the second terminal of the drive transistor;

the initialization phase further comprises placing the sixth switch transistor in an on state to electrically connect the first terminal of the light-emitting device to the initialization voltage supply line through the sixth switch transistor to initialize the voltage at the light-emitting device;

the individual pixel circuit further comprises a seventh switch transistor having a first terminal connected to the first terminal of the light emitting device and a second terminal connected to the second terminal of the drive transistor and the second terminal of the sixth switch transistor, and an eighth switch transistor having a first terminal connected to the first power supply line and a second terminal connected to the first terminal of the drive transistor;

the initialization phase further comprises placing the seventh switch transistor in an on state to electrically connect the first terminal of the light-emitting device to the initialization voltage supply line through the sixth and seventh switch transistors to initialize the voltage at the light-emitting device; and the emission phase further comprises placing the seventh and eight switch transistors in an on state to electrically connect the first terminal of the light-emitting device to the first power supply line through the eighth switch transistor, the drive transistor, and the seventh switch transistor.

10. The method of operating a display panel of claim 4, wherein the data pre-loading phase of a current frame occurs during the emission phase of a previous frame.

11. The method of operating a display panel of claim 4, wherein the reference voltage changes from a first voltage value to a second voltage value at the end of the initialization phase, and changes from the second voltage value to the first voltage value during the emission phase.

12. The method of operating a display panel of claim 4, further comprising:

arranging a plurality of individual pixel circuits in a pixel array of "n" rows by "m" columns wherein "n" and "m" are integers greater than one;

applying a common global emission control signal GEMI to multiple individual pixel circuits of the pixel array during the initialization and emission phases;

applying a common global initialization control signal GINT to multiple individual pixel circuits of the pixel array during the initialization and data transfer and programming phases;

applying a common global programming control signal GPRG to multiple individual pixel circuits of the pixel array during the data transfer and programming phase;

applying the common global initialization control signal GINT to the first switch transistors of multiple individual pixel circuits of the pixel array during the initialization and data transfer and programming phases; and applying the common global programming control signal GPRG to the second switch transistors of multiple individual pixel circuits of the pixel array during the data transfer and programming phase.

13. The method of operating a display panel of claim 9, further comprising:

arranging a plurality of individual pixel circuits in a pixel array of "n" rows by "m" columns wherein "n" and "m" are integers greater than one;

applying a common global initialization control signal GINT to the first, fourth, and sixth switch transistors of multiple individual pixel circuits of the pixel array during the initialization and data transfer and programming phases;

applying a common global emission control signal GEMI to the third, seventh, and eighth switch transistors of multiple individual pixel circuits of the pixel array during the initialization and emission phases; and applying a common global programming control signal GPRG to the second switch transistors of multiple individual pixel circuits of the pixel array during the data transfer and programming phase.

14. The method of operating a display panel of claim 4, further comprising applying a SCAN signal to each row of the pixel array, wherein the SCAN signals are applied on a row by row basis to sequentially electrically connect the data holding capacitors of the individual pixel circuits to the voltage data lines on the row by row basis to pre-load a respective data voltage onto the data holding capacitors during the data pre-loading phase.

* * * * *